US005910026A

United States Patent [19]

Geib et al.

[11] Patent Number: 5,910,026

[45] Date of Patent: Jun. 8, 1999

[54] ELECTRICAL CONNECTOR WITH CABLE STRAIN RELIEF

[75] Inventors: Lawrence E. Geib, Bartlett; Chandrasekaran Krishnaswamy, Lisle; Gregory Paul Meyer, Elk Grove, all of Ill.

[73] Assignee: Molex Incorporated, Lisle, Ill.

[21] Appl. No.: 08/794,084

[22] Filed: Feb. 4, 1997

[51] Int. Cl.[6] ..... H01R 13/58

[52] U.S. Cl. ..... 439/471; 439/464

[58] Field of Search ..... 439/464, 465, 439/471, 473, 468

[56] References Cited

U.S. PATENT DOCUMENTS

| | | | |
|---|---|---|---|
| 3,349,364 | 10/1967 | Paullus et al. | 339/105 |
| 4,195,899 | 4/1980 | Radloff et al. | 339/103 |
| 4,280,746 | 7/1981 | Ignatowicz | 339/107 |
| 4,341,431 | 7/1982 | Woratyla | 439/471 |
| 4,488,769 | 12/1984 | Feigl | 439/471 |
| 4,538,869 | 9/1985 | Richards | 339/59 M |
| 4,840,581 | 6/1989 | Leufert et al. | 439/472 |
| 4,842,550 | 6/1989 | Fry, Jr. et al. | 439/471 |
| 4,900,277 | 2/1990 | Inaba et al. | 439/471 |
| 5,620,333 | 4/1997 | Boyle | 439/471 |
| 5,620,334 | 4/1997 | Quillet et al. | 439/471 |

FOREIGN PATENT DOCUMENTS

| | | | |
|---|---|---|---|
| 0 159 121 | 1/1985 | European Pat. Off. | H01R 13/58 |
| 0 183 939 | 9/1985 | European Pat. Off. | H01R 13/46 |
| 695008-A1 | 7/1995 | European Pat. Off. | H02G 3/06 |
| 0 744 791 A2 | 11/1996 | European Pat. Off. | H01R 13/58 |
| 7211388 | 11/1995 | Japan | H01R 13/58 |
| WO 86/01042 | 2/1986 | WIPO | H01R 13/595 |

*Primary Examiner*—Hien Vu
*Attorney, Agent, or Firm*—Stacey E. Caldwell

[57] ABSTRACT

An electrical connector assembly is disclosed for terminating the conductors of an electrical cable. A dielectric housing includes a plurality of terminal-receiving passages for receiving a plurality of terminals terminated to the conductors of the cable. A discrete dielectric cover is removably mounted on the housing over a termination end thereof. A discrete dielectric strain relief member is mounted on the housing near the termination end thereof and to which the electrical cable can be fixed. The cover is mounted to the housing independently of the strain relief member, whereby the cover can be removed from the housing without removing the strain relief member and the affixed cable. The strain relief member can be mounted on the housing at a plurality of different locations, whereby the cable can exit the connector from the housing in different locations and orientations.

15 Claims, 8 Drawing Sheets

ELECTRICAL CONNECTOR WITH CABLE STRAIN RELIEF

FIELD OF THE INVENTION

This invention generally relates to the art of electrical connectors and, particularly, to a strain relief system for holding an electrical cable to a connector.

BACKGROUND OF THE INVENTION

Electrical connectors are used in a variety of applications wherein an electrical cable, including a plurality of conductors, is terminated to a plurality of terminals in the connector housing. Once the cable is terminated to the housing, there is a tendency to grab onto or hold the connector by means of the cable itself, or even to disconnect the connector by pulling on the cable. Such actions can cause the conductors of the cable to be pulled out of their respective terminals or actually pull the terminals out of the connector housing. Consequently, electrical connectors often have some form of strain relief means for clamping onto the cable so that forces from the cable are transmitted to the strain relief means and, in turn, to the connector housing rather than being transmitted to the terminals terminated to the conductors of the cable.

A typical application of such a system is in automotive assembly line operations wherein bundled wire assemblies are managed as single bundled units. A bundled wire unit may be terminated to a connector to define a wiring harness. The managing and handling of this wiring harness during assembly is often manual and done by way of grabbing the bundle of wires. Therefore, the connectors terminated to the wire bundles are provided with strain reliefs to ensure that when the wires are pulled or handled, the resulting tensile forces are transmitted from the wires through the strain relief means to the housing and not to the terminals.

Known strain relief members have been molded integrally with the connector housing or cover to reduce the number of components associated with the connector assembly. However, integrally molded strain relief members have presented various problems. For instance, one problem associated with integrally molded strain relief members is due to the fact that in some applications, such as in automotive assembly applications, the wire bundles are held to the strain relief members by cable wraps, tape, cable ties or the like. If a particular wire or terminal must be reworked within the connector housing, the entire wire bundle must be unwrapped and untaped from the strain relief member in order to access the particular wire or terminal. After reworking, the entire wire bundle must be reassembled and retaped to the integral strain relief member of the housing. This procedure can be costly in terms of time and labor.

Another problem associated with integrally molded strain relief members is that connector designs often are developed for particular customer applications which have specific configurations that route the wire bundles. While the connector itself may mate with a complementary connector in a given orientation, the wire bundles may have to exit the connector in a particular direction. These varying configurations require that the integral strain relief member be molded in a particular shape or configuration to ensure the customized routing of the wire bundle. These varying configurations and applications necessitate different strain relief and housing designs for each different orientation or location of the strain relief. This is very costly in terms of mold expenses, design time and inventory requirements. Even if a separate strain relief member is provided independent of the connector housing, various design specifications require the strain relief member to be positioned at different locations on the housing and a multiplicity of different housing configurations and resulting mold and inventory costs are incurred.

The present invention is directed to solving these various problems in an electrical connector having a strain relief system for an electrical cable.

SUMMARY OF THE INVENTION

An object, therefore, of the invention is to provide an electrical connector assembly including a new and improved strain relief system for mounting an electrical cable in a variety of configurations.

In the exemplary embodiment of the invention, the electrical connector assembly includes a dielectric housing having a plurality of terminal-receiving passages for receiving a plurality of terminals terminated to the conductors of the electrical cable. A discrete dielectric strain relief member is adapted for affixing the electrical cable thereto. Generally, complementary interengaging mounting means are provided on the housing and the strain relief member for mounting the strain relief member on the housing at a plurality of different locations, whereby the electrical cable can exit the housing in different directions or orientations.

The invention also contemplates that a discrete dielectric cover is removably mounted on the housing over a termination end thereof. The cover is mounted to the housing independently of the strain relief member, whereby the cover can be removed from the housing without removing the strain relief member and the affixed cable.

The complementary interengaging mounting means between the housing and the strain relief member include a plurality of receptacles spaced about the periphery of the housing to mount the strain relief member at a plurality of different locations. The receptacles and the strain relief member include complementary snap-latch means for readily mounting the strain relief member in any one of the receptacles. Preferably, the receptacles are located about the termination end of the housing.

As disclosed herein, the strain relief member has an arcuate portion for embracing the electrical cable and a recessed portion for receiving a cable wrap generally perpendicular to the cable. The strain relief member has a lip adjacent the recessed portion to prevent the cable wrap from sliding off the strain relief member. The member may be molded of dielectric material and include integral strengthening ribs to minimize the effect of torsional stresses thereon.

Lastly, it is contemplated that a set of strain relief members be provided in different configurations. Any one of the different strain relief members can be mounted on the housing in any one of the receptacles at the different locations.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the acompanying drawings, in which like reference numerals identify like elements in the figures and in which:

DETAILED DESCRIPTION OF THE PREFERRED EMBODIMENTS

Figure 1:
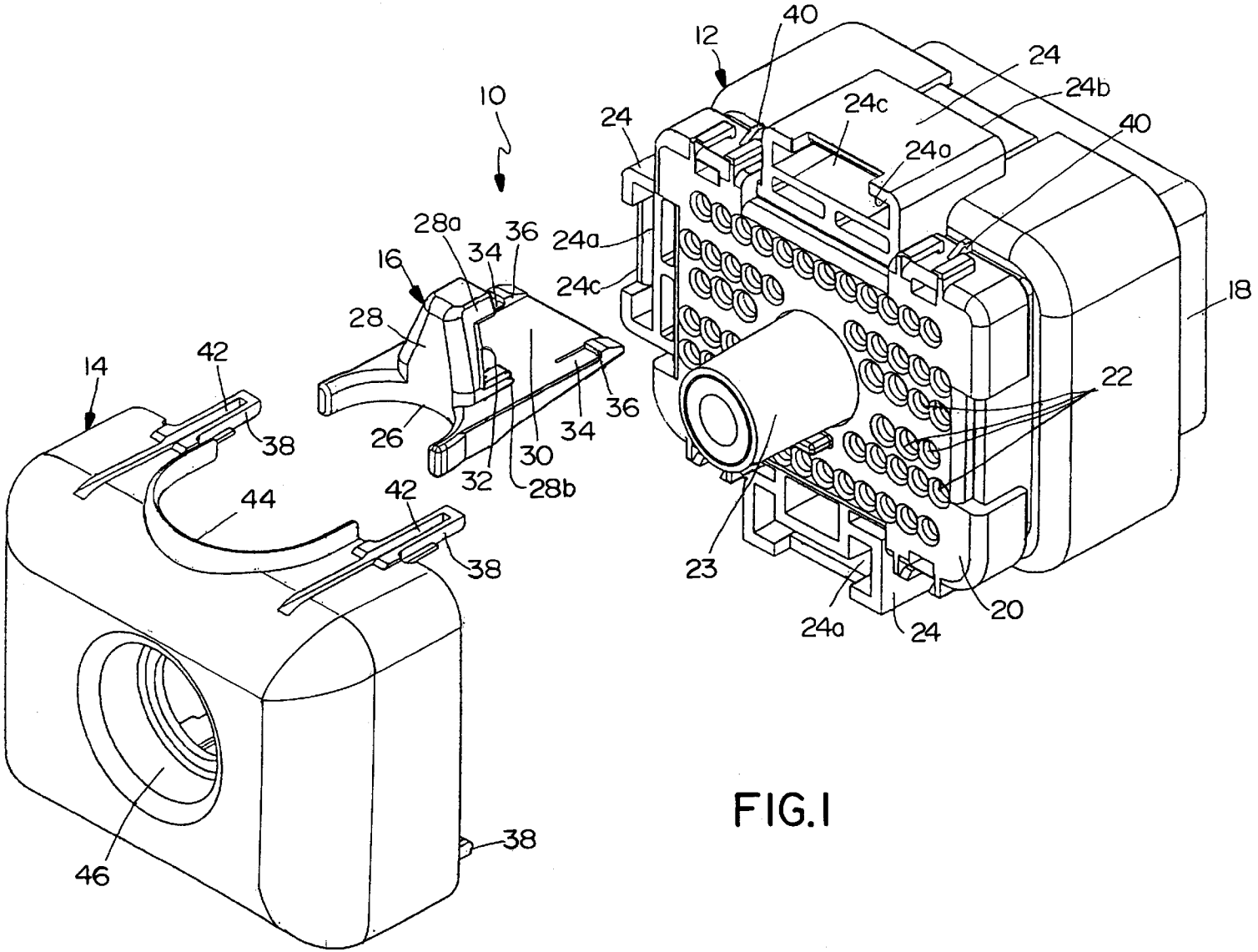
FIG. 1 is an exploded perspective view of a first embodiment of an electrical connector assembly incorporating the concepts of the invention.

Referring to the drawings in greater detail, and first to FIG. 1, an electrical connector assembly, generally designated 10, is shown for termination to the conductors of an electrical cable as described hereinafter.

The assembly includes three major components, namely: a one-piece dielectric housing, generally designated 12; a discrete dielectric cover, generaly designated 14; and a discrete dielectric strain relief member, generally designated 16. As will be seen hereinafter, complementary interengaging mounting means in the form of receptacles 24 and planar body portions are provided on the housing and strain relief members respectively, such that strain relief member 16 is mountable on housing 12 in a plurality of different locations thereon. Cover 14 is removably mounted on the housing independent of strain relief member 16.

More particularly, housing 12 includes a front mating end 18 and a rear termination end 20. The front mating end is adapted for mating with a complementary connector or other mating connecting device. Termination end 20 is at the rear of the housing, and a plurality of terminal-receiving passages 22 are formed in the housing in a front-to-rear direction for receiving a plurality of terminals (not visible in the drawing) terminated to the conductors of the electrical cable as is known in the art. The conductors will exit the housing from passages 22 at termination end 20 which is seen clearly in FIG. 1. A mounting post 23 projects rearwardly from termination end 20 for receiving a bolt or other fastener to secure the connector assembly to a complementary connector or other mating connector device. A plurality of receptacles 24 are formed integrally with housing 12 about the periphery thereof, particularly about the periphery of the termination end 20 of the housing. Actually, there are three receptacles 24 on three sides of housing 12, as shown. Each receptacle defines an interior cavity 24*a*, a forwardly facing ledge 24*b* and a rearwardly facing notch 24*c*. The one-piece housing, including receptacles 24, is unitarily molded of dielectric material such as plastic or the like.

Figure 2:
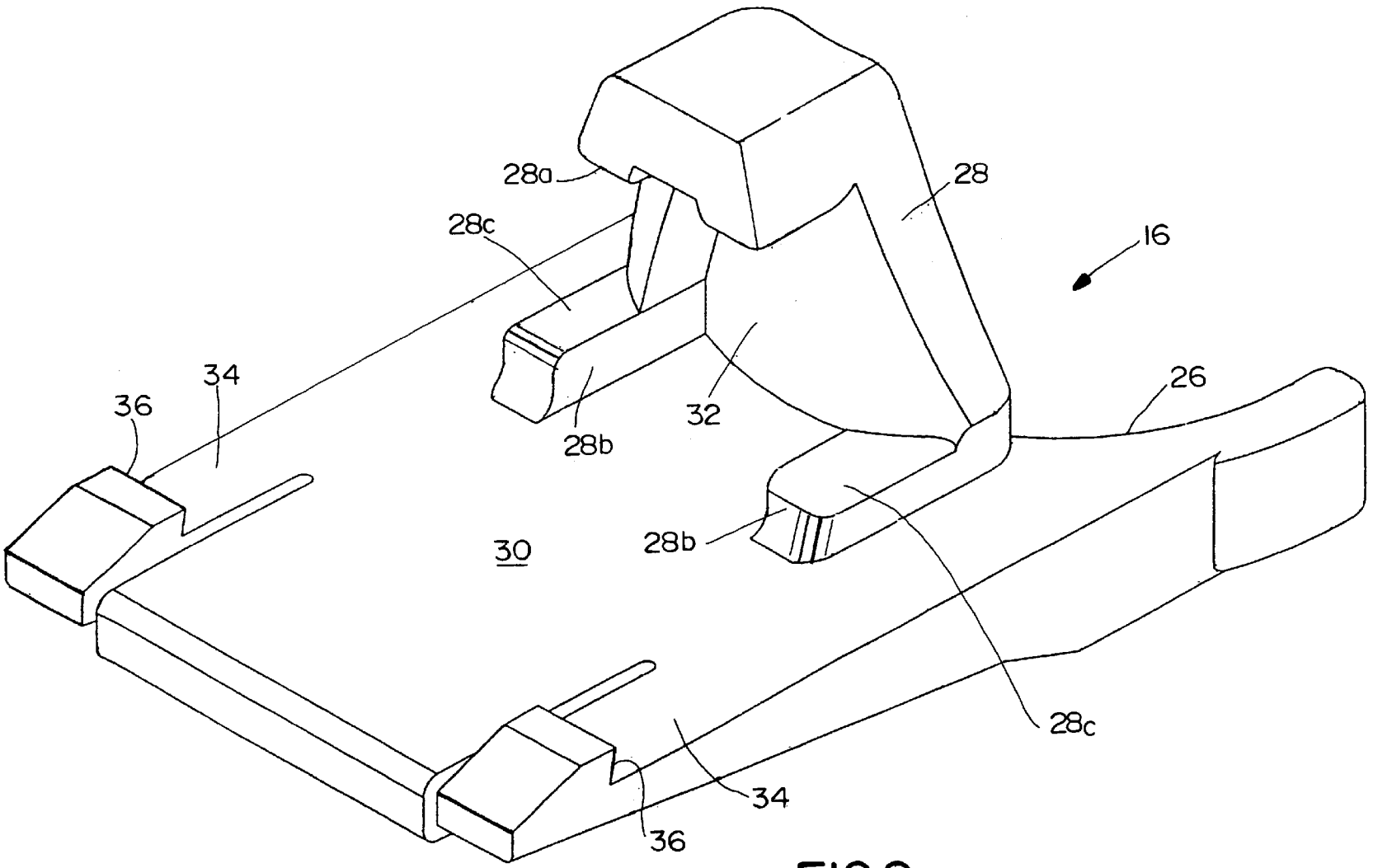
FIG. 2 is a perspective view of the strain relief member in FIG. 1 rotated 180° therefrom.

Referring to FIG. 2 in conjunction with FIG. 1, dielectric strain relief member 16 also is a one-piece structure molded of dielectric material such as plastic or the like. The strain relief member may be fabricated of a different material from housing 12 to provide different characteristics, such as a material which may be more resistant to torsional forces. The strain relief member includes an arcuate portion 26 which, in part, embraces the electrical cable as will be seen hereinafter. An arm 28 projects generally perpendicular to a generally planar body portion 30 and defines a recessed area 32 about which a cable wrap or tie can be wrapped generally perpendicular to the cable. A pair of flexible latch arms 34 are formed out of planar body portion 30 and define snap-latch hooks 36. Arm 28 has a lip 28*a* at its distal end and abutment shoulders 28*b* at its opposite end for purposes described hereinafter. Ribs 28*c* serve as structural supports to strengthen the arm's resistance to torsional forces.

As stated above, cover 14 is mountable on housing 12 independent of strain relief member 16. In particular, the cover includes four latch arms 38 which snap over four latch bosses 40 on the outside of housing 12 near termination end 20. Actually, latch arms 38 have slots 42 whereby latch bosses 40 snap into the slots and abut against closed ends of the slots at the distal ends of the arms. Housing 14 also has an arcuate portion 44 which cooperates with arcuate portion 26 of strain relief member 16 to define an opening through which the electrical cable can exit from the housing after the conductors or wires of the cable are terminated to the terminals within the housing. Lastly, cover 14 has a hole 46 through which mounting post 23 projects for receiving the securing bolt or fastener, as described above.

Figure 3:
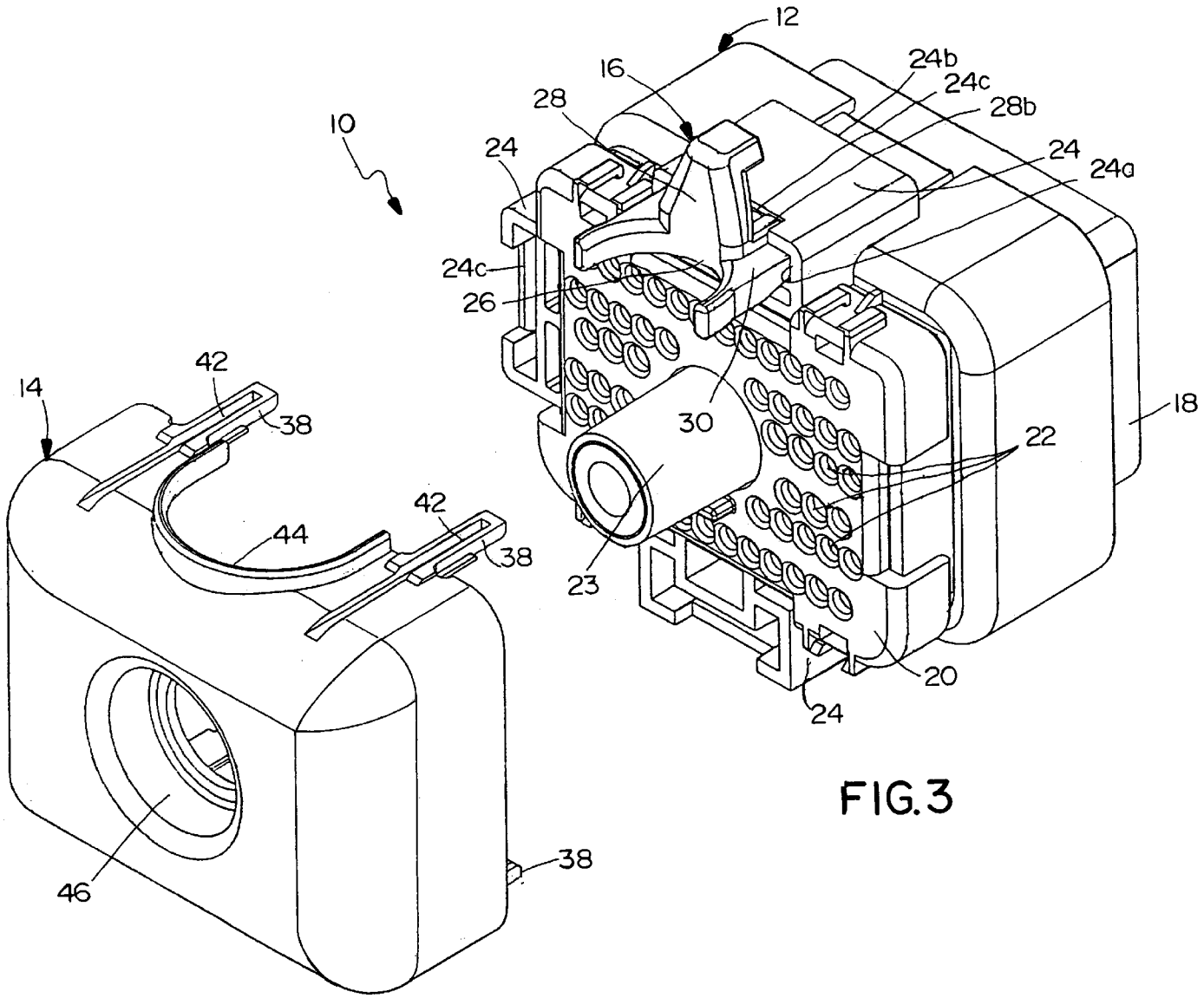
FIG. 3 is an exploded perspective view of the assembly of FIG. 1, with the strain relief member mounted on the housing.

FIG. 3 shows strain relief member 16 mounted in one of the receptacles 24 of the housing. In particular, the strain relief member is mounted to the housing by inserting planar body portion 30 of the strain relief into cavity 24*a* of the receptacle until abutment shoulders 28*b* engage notch 24*c* and hooks 36 of latch arms 34 resiliently snap into locking engagement behind ledge 24*b* of the receptacle. Arcuate portion 26 of the strain relief member thereby faces rearwardly away from termination end 20 of the housing. Of course, it must be understood that strain relief member 16 can be inserted into any one of the receptacles 24, as described above.

Figure 4:
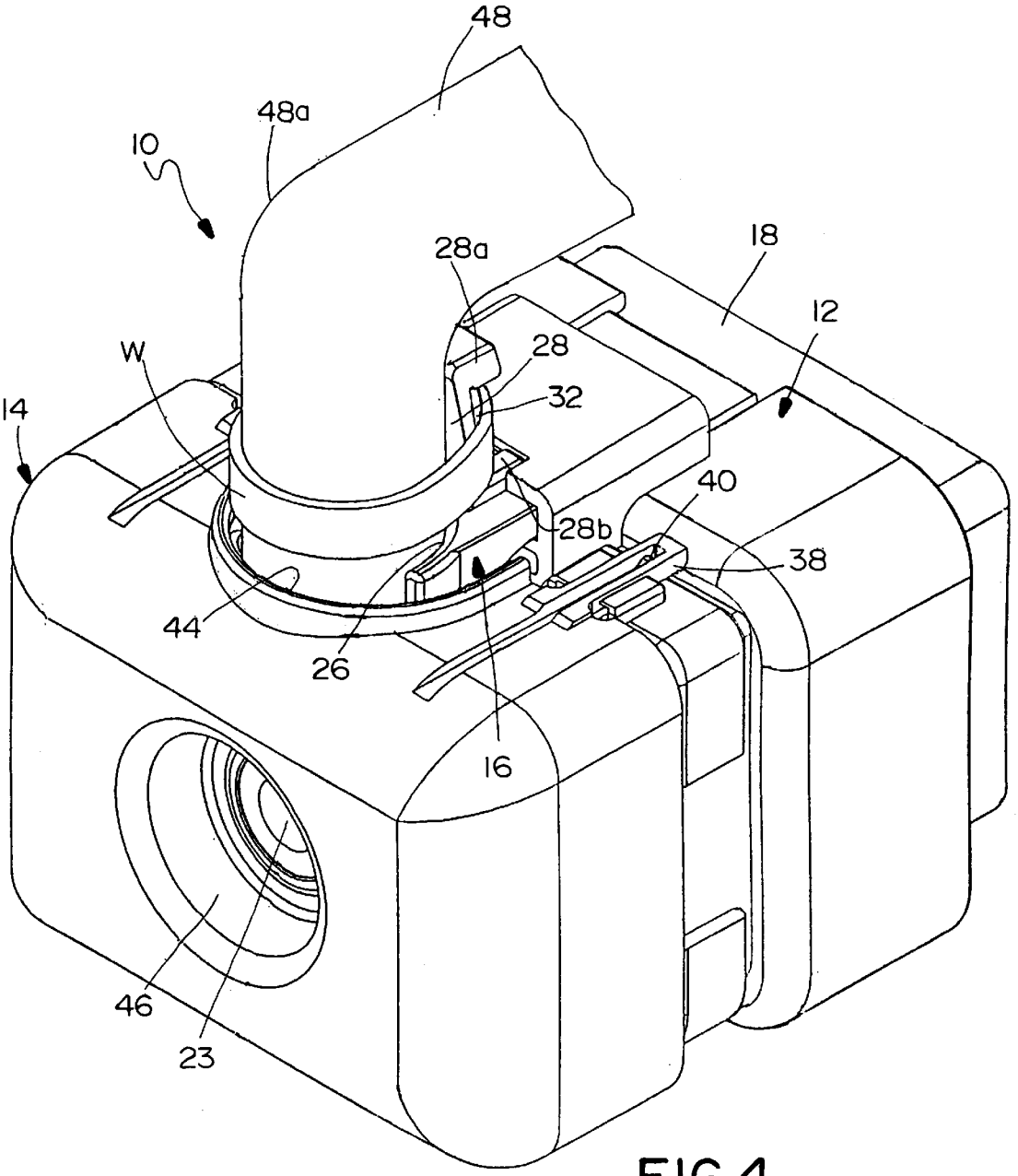
FIG. 4 is a perspective view of the connector assembly of FIG. 1 in assembled condition.

FIG. 4 shows cover 14 having been mounted on housing 12 by snapping latch arms 38 of the cover over latch bosses 40 of the housing. During assembly, mounting post 23 projecting from the housing either enters or becomes aligned with hole 46 in the cover. An electrical cable 48 is shown projecting from connector assembly 10 in FIG. 4. It can be seen how arcuate portion 26 of strain relief member 16 combines with arcuate portion 44 of cover 14 to define an opening through which the cable can exit from the housing. A cable wrap "W" is shown wrapped about the cable and about arm 28 of the strain relief member within recessed area 32 thereof. Lip 28*a* of the strain relief member prevents the cable wrap from sliding off of arm 28. In the assembly of FIG. 4, it can be understood from the above that the configuration of the strain relief member is such as to orient the cable in a direction generally parallel to the rear termination end of the connector housing as the cable exits the housing. Of course, once the cable exits the housing, the cable can be bent, as at 48*a*, in different directions.

Figure 5:
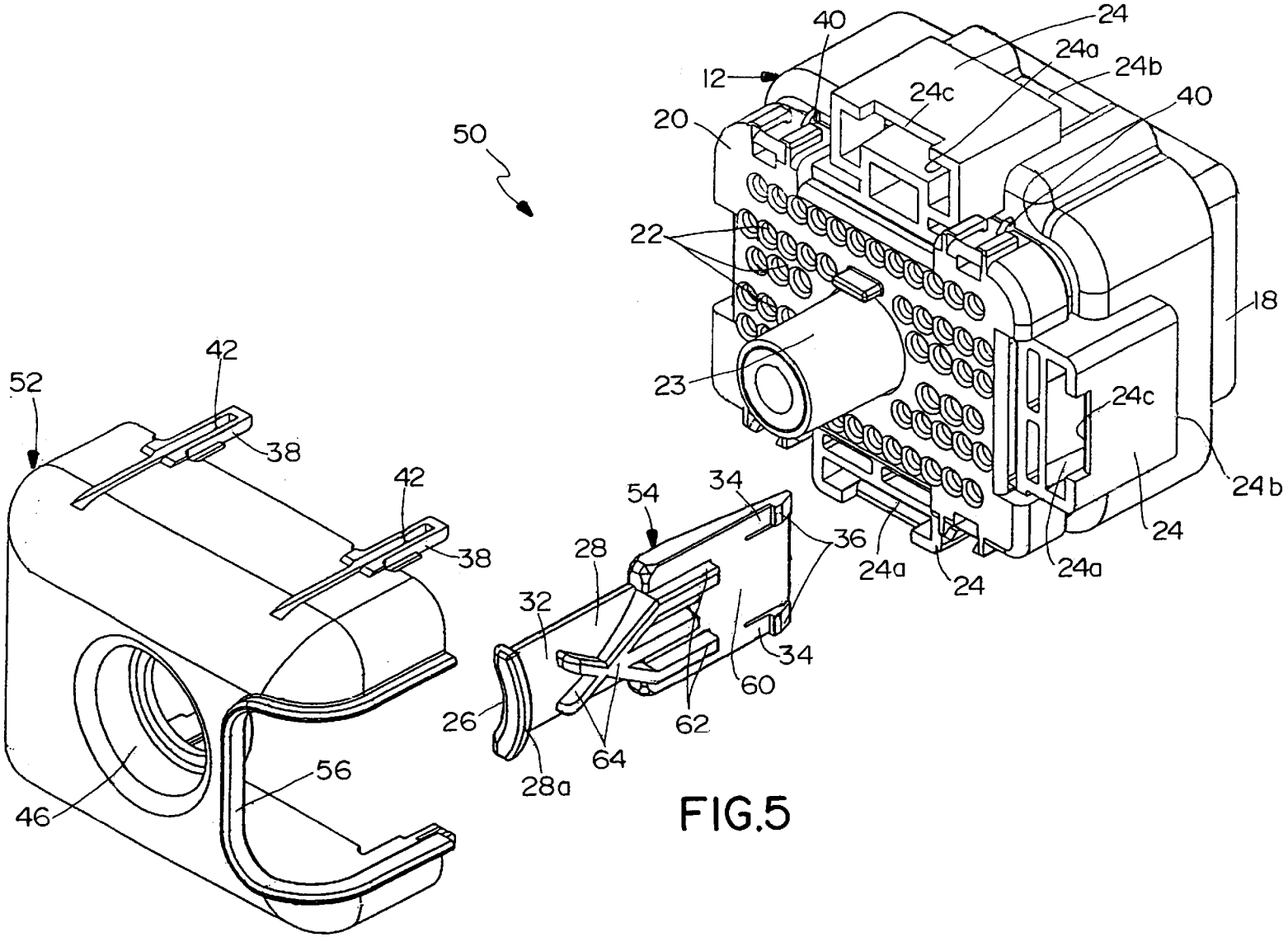
FIG. 5 is an exploded perspective view of a second embodiment of an electrical connector assembly incorporating the concepts of the invention.
Figure 6:
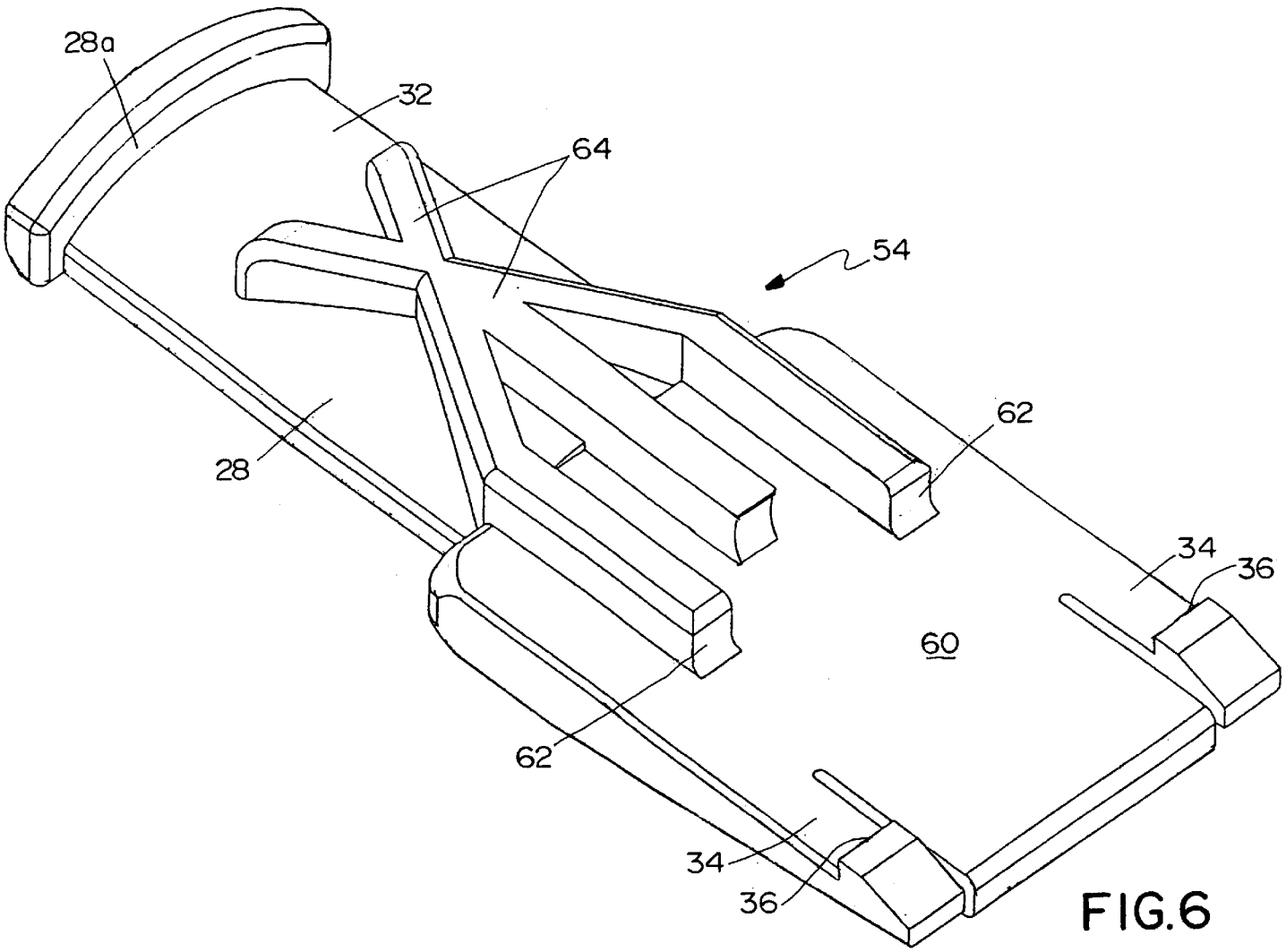
FIG. 6 is a perspective view of the strain relief member in the assembly of FIG. 5.
Figure 7:
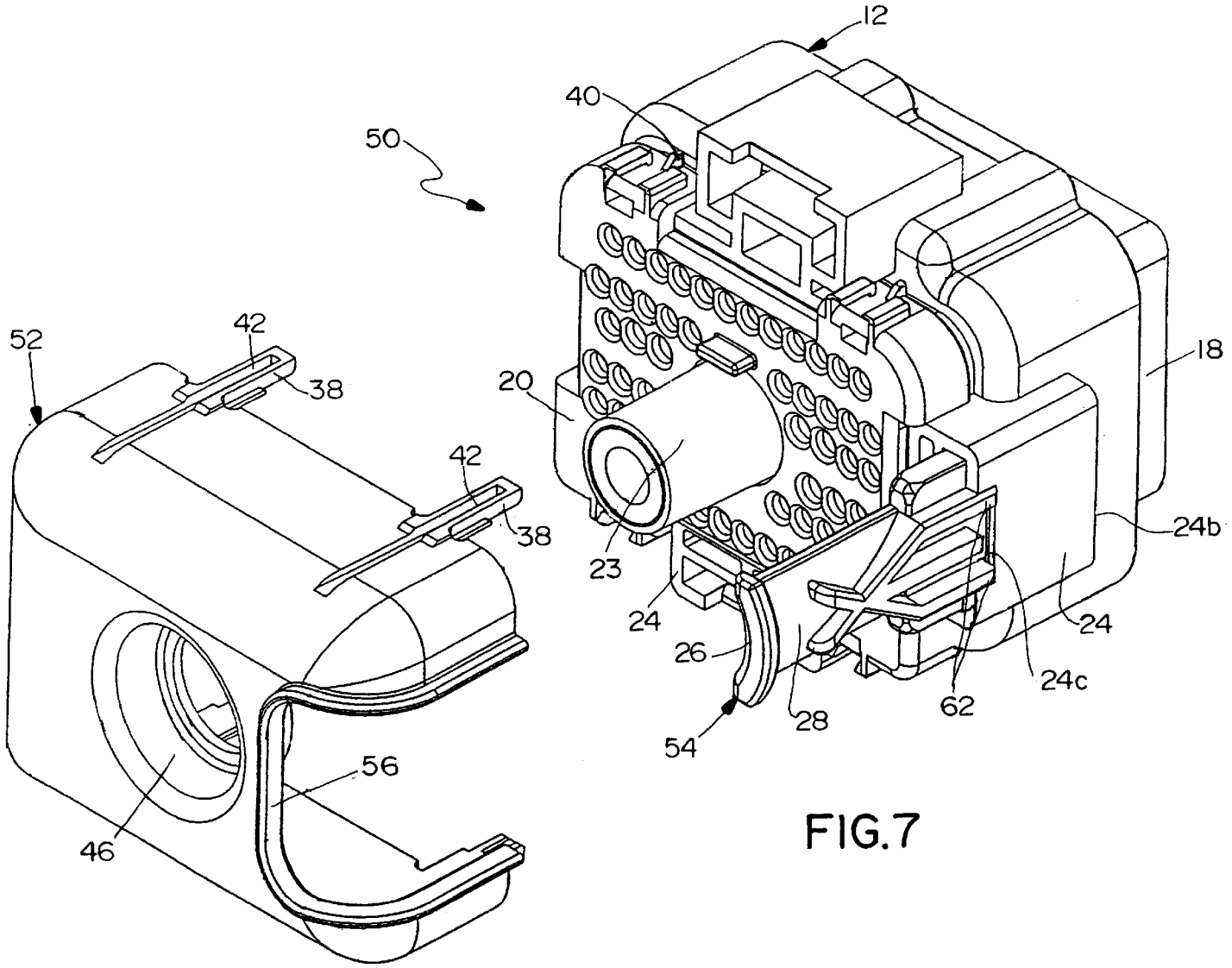
FIG. 7 is an exploded perspective view of the assembly of FIG. 5, with the strain relief member mounted on the housing.
Figure 8:
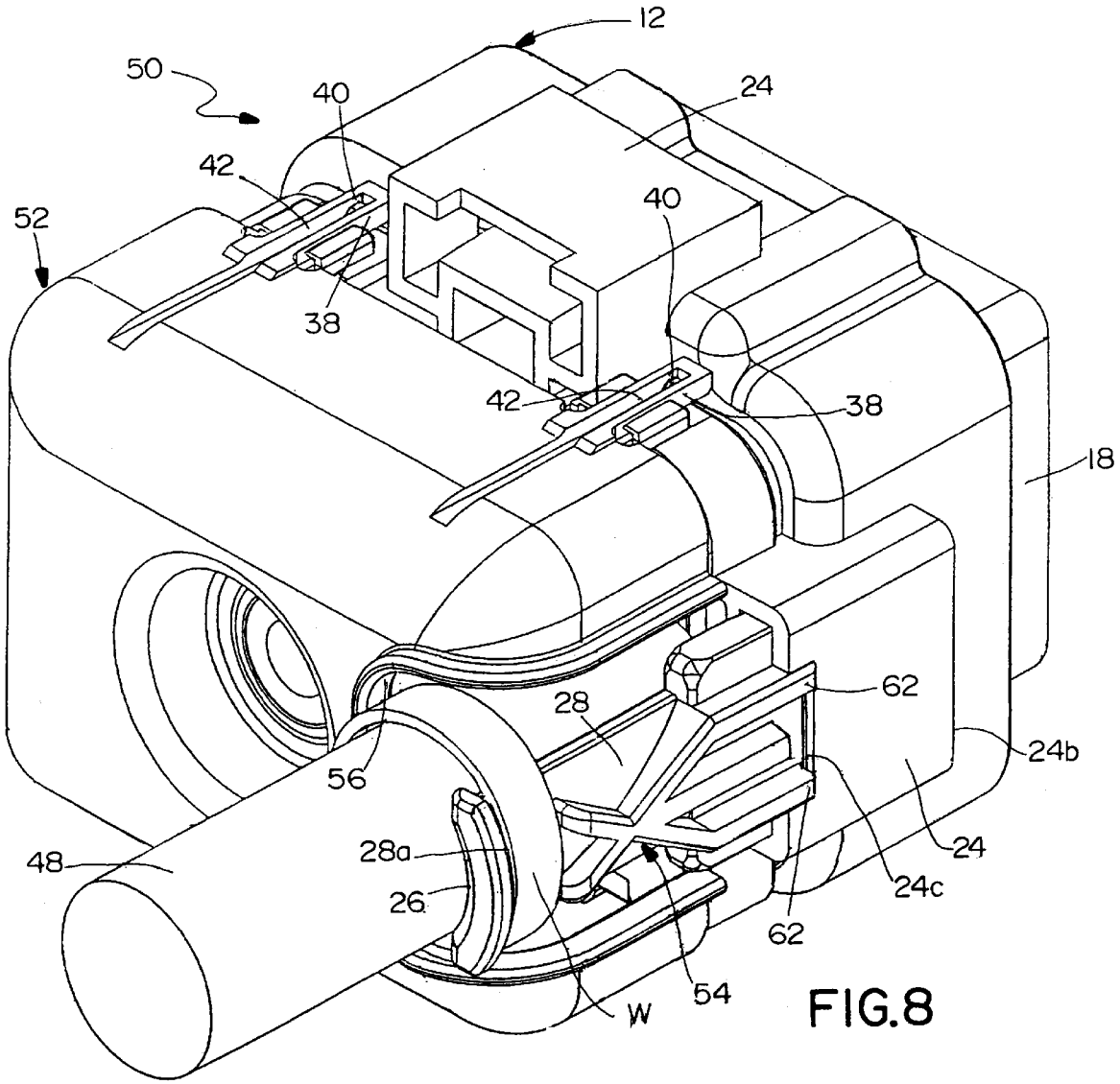
FIG. 8 is a perspective view of the assembly of FIG. 5, in assembled condition.

FIGS. 5–8 show a second embodiment of an electrical connector assembly, generally designated 50, which includes a one-piece integrally molded housing, generally designated 12. The housing is substantially identical to that shown in FIGS. 1–4 and described above. In FIGS. 5, 7 and 8, the housing simply has been rotated 180° versus the orientation of the housing in FIGS. 1, 3 and 4. Therefore, like reference numerals have been applied to the housing and its components as described above.

In addition to the housing, connector assembly 50 (FIGS. 5, 7 and 8) includes a discrete dielectric cover, generally designated 52, and a discrete dielectric strain relief member, generally designated 54. Each of the cover and strain relief member is molded in one-piece of plastic material or the like.

Like cover 14 of connector assembly 10, cover 52 includes four latch arms 38 having slots 42, whereby the latch arms can snap-latchingly engage over four latch bosses 40 of housing 12. Housing 52 also includes a hole 46 for receiving mounting post 23 of the housing. Lastly, housing 52 includes a side open area 56 which cooperates with strain relief member 54 to define an opening through which the electrical cable can exit from the housing, as seen hereinafter.

Referring to FIGS. 5 and 6, strain relief member 54 of connector assembly 50 includes a planar body portion 60 for insertion into the cavity 24*a* of any one of the receptacles 24 of the housing. The strain relief member again includes abutment shoulders 62 for engaging the rearwardly facing notch 24*c* of the respective receptacle. Like strain relief member 16 of connector assembly 10, strain relief member 54 includes a pair of latch arms 34 with latch hooks 36 for snappingly engaging behind ledge 24*b* of the respective receptacle. Also like strain relief member 16 of connector assembly 10, strain relief member 54 includes an arcuate portion 26 for embracing the electrical cable, a recessed area 32 for receiving a cable wrap generally perpendicular to the cable and a lip 28*a* on the distal end of an arm 28 to prevent the cable wrap from sliding off of the strain relief member. Lastly, strain relief member 54 includes a plurality of integral strengthening ribs 64 to minimize the effect of torsional stresses on the strain relief member.

FIG. 7 shows strain relief member 54 of connector assembly 50 having been inserted into one of the receptacles 24 at the right-hand periphery of housing 12. As with strain relief member 16 in FIG. 3, strain relief member 54 seats in the receptacle by abutment shoulders 62 engaging notch 24*c* and snap-latch hooks 36 of latch arms 34 engaging ledge 24*b* of the receptacle. In comparing arm 28 of strain relief member 54 in FIG. 7 with arm 28 of strain relief member 16 in FIG. 3, it can be seen that strain relief member 54 is designed to orient the electrical cable to extend in a front-to-rear direction (i.e. generally perpendicular to termination end 20 of housing 12) which is generally perpendicular to the electrical cable exiting the housing in the embodiment of FIGS. 1–4.

FIG. 8 shows this configuration of electrical cable 48 exiting the connector in the front-to-rear direction. In fact, if strain relief member 54 is inserted in any one of the receptacles 24, the cable will extend away from housing 12 in a rearward direction.

From the foregoing, it can be understood that a single connector housing 12 not only can accommodate different shapes of strain relief members 16 and 54, but the housing can receive the different strain relief members in different locations about the periphery of the housing. Therefore, a single housing can be used in a wide variety of applications, resulting in significant reductions in molding, manufacturing and inventory costs. In fact, by using only two different configurations of strain relief members as shown herein, along with the illustrated housing having three differently located receptacles 24, six different cable orientations/locations can be achieved with the same housing. If a fourth receptacle is added to the fourth side of the housing, eight different orientations/locations for the cable could be achieved with only two different configurations of strain relief members. This is quite significant when taking in consideration the costs involved in the rather expensive housing which has many passages molded for receiving a plurality of terminals. Of course, the less expensive cover must be different for cooperation with the strain relief member in different locations or configurations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly for terminating the conductors of an electrical cable, comprising:

a dielectric housing having a front mating end and a rear termination end including a plurality of terminal-receiving passages extending between the ends for receiving a plurality of terminals terminated to the conductors of the electrical cable;

a discrete dielectric cover removably mounted on the housing at the termination end thereof substantially entirely covering the termination end of the terminal-receiving passages; and a discrete dielectric strain relief member mounted on the housing at one of a plurality of mounting lotions near the termination end thereof and to which the electrical cable can be fixed;

wherein the cover and the strain relief member combine to define an opening through which the cable can exit the connector from the housing and the cover is mounted to the housing independently of the strain relief member such that the cover can be removed from the housing without removing the strain relief member and the affixed cable.

2. The electrical connector of claim 1 wherein said strain relief member has an arcuate portion for embracing the cable and a recessed portion for receiving a cable wrap generally perpendicular to the cable.

3. The electrical connector of claim 2 wherein said strain relief member has a lip adjacent the recessed portion to prevent the cable wrap from sliding off the strain relief member.

4. The electrical connector of claim 1 wherein said strain relief member is molded of dielectric material and includes integral strengthening rib means to minimize the effect of torsional stresses thereon.

5. The electrical connector of claim 1 wherein said strain relief member has a recessed area for receiving a cable wrap, with a lip adjacent the recessed area to prevent the cable wrap from sliding off the strain relief member.

6. An electrical connector assembly for terminating the conductors of an electrical cable, comprising:

a dielectric housing including a plurality of terminal-receiving passages for receiving a plurality of terminals terminated to the conductors of the electrical cable;

a strain relief member adapted for affixing the electrical cable thereto; and complementary interengaging mounting means on the housing and the strain relief member for mounting the strain relief member on the housing at a plurality of different locations whereby the cable can exit the housing in different directions and orientations, wherein said complementary interengaging mounting means include a plurality of receptacles spaced about the periphery of the housing.

7. The electrical connector of claim 6 wherein the receptacles and the strain relief member include complementary snap-latch means for readily mounting the strain relief member in any one of the receptacles.

8. The electrical connector of claim 6 wherein said housing includes a termination end, and said receptacles are located about the termination end.

9. The electrical connector of claim 8, including a discrete dielectric cover removably mounted on the housing over said termination end thereof.

10. The electrical connector of claim 6 wherein said strain relief member has an arcuate portion for embracing the cable and a recessed portion for receiving a cable wrap generally perpendicular to the cable.

11. The electrical connector of claim 10 wherein said strain relief member has a lip adjacent the recessed portion to prevent the cable wrap from sliding off the strain relief member.

12. The electrical connector of claim 6 wherein said strain relief member is molded of dielectric material and includes integral strengthening rib means to minimize the effect of torsional stresses thereon.

13. The electrical connector of claim 6 wherein said strain relief member has a recessed area for receiving a cable wrap, with a lip adjacent the recessed area to prevent the cable wrap from sliding off the strain relief member.

14. The electrical connector of claim 6, including a discrete dielectric cover removably mounted on the housing independently of the strain relief means.

15. The electrical connector of claim 6, including a set of said strain relief members of different configurations all mountable on the housing at said different locations.

* * * * *